US011293147B2

(12) United States Patent
Rudge

(10) Patent No.: US 11,293,147 B2
(45) Date of Patent: Apr. 5, 2022

(54) VIBRATORY COMPACTION MACHINES PROVIDING COORDINATED IMPACTS FROM FIRST AND SECOND DRUMS AND RELATED CONTROL SYSTEMS AND METHODS

(71) Applicant: Volvo Construction Equipment AB, Eskilstuna (SE)

(72) Inventor: Brian Rudge, Carlisle, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 46 days.

(21) Appl. No.: 16/495,498

(22) PCT Filed: Mar. 21, 2017

(86) PCT No.: PCT/US2017/023289
§ 371 (c)(1),
(2) Date: Sep. 19, 2019

(87) PCT Pub. No.: WO2018/174853
PCT Pub. Date: Sep. 27, 2018

(65) Prior Publication Data

US 2020/0018019 A1 Jan. 16, 2020

(51) Int. Cl.
*E01C 19/28* (2006.01)
*E01C 23/07* (2006.01)
(Continued)

(52) U.S. Cl.
CPC ..... *E01C 19/286* (2013.01); *E01C 19/282* (2013.01); *E01C 19/288* (2013.01);
(Continued)

(58) Field of Classification Search
CPC .... E01C 19/282; E01C 19/286; E01C 19/288; E01C 23/07; B06B 1/162; E02D 3/026; E02D 3/074
(Continued)

(56) References Cited

U.S. PATENT DOCUMENTS 3,435,741 A 4/1969 Mozdzanowski
3,737,244 A 6/1973 Wilson
(Continued)

FOREIGN PATENT DOCUMENTS

CN 102561154 A 7/2012
CN 202298427 U 7/2012
(Continued)

OTHER PUBLICATIONS

International Search Report and Written Opinion dated Aug. 11, 2017 for International Patent Application No. PCT/US2017/023289, 11 pages.
(Continued)

*Primary Examiner* — Raymond W Addie
(74) *Attorney, Agent, or Firm* — Sage Patent Group

(57) ABSTRACT

A compaction machine may include a chassis, first and second drums rotatably mounted to the chassis, first and second vibration mechanisms, and a vibration controller. The first vibration mechanism may be configured to generate vibrations that are transmitted as impacts by the first drum to a work surface, and the second vibration mechanism may be configured to generate vibrations that are transmitted as impacts by the second drum to the work surface. The vibration controller may be configured to control at least one of the first and second vibration mechanisms so that a first pattern of impacts transmitted to the work surface by the first drum and a second pattern of impacts transmitted to the work surface by the second drum are coordinated as the
(Continued)

compaction machine moves over the work surface. Related controllers and methods are also discussed.

17 Claims, 4 Drawing Sheets

(51) Int. Cl.
*E02D 3/026* (2006.01)
*B06B 1/16* (2006.01)
*E02D 3/074* (2006.01)

(52) U.S. Cl.
CPC ..... *E01C 23/07* (2013.01); *E02D 3/026* (2013.01); *B06B 1/162* (2013.01); *E02D 3/074* (2013.01)

(58) Field of Classification Search
USPC ..... 404/84.05–84.1, 113, 117
See application file for complete search history.

(56) References Cited

U.S. PATENT DOCUMENTS 4,088,077 A 5/1978 von Beckmann
4,382,715 A 5/1983 Vural et al.
4,546,425 A * 10/1985 Breitholtz ..... E01C 19/288 700/33
5,695,298 A * 12/1997 Sandstrom ..... E01C 19/286 404/117
6,431,790 B1 * 8/2002 Anderegg ..... E01C 19/288 366/116
6,561,729 B1 * 5/2003 Potts ..... E01C 19/286 404/117
6,637,280 B2 * 10/2003 Potts ..... B06B 1/166 404/113
7,938,595 B2 * 5/2011 Potts ..... E01C 19/288 404/84.1
8,439,598 B2 * 5/2013 Norton ..... E01C 19/26 404/75
8,585,317 B1 * 11/2013 Sina ..... E02D 3/074 404/117
9,039,319 B2 * 5/2015 Oetken ..... E01C 19/288 404/75
9,039,324 B2 5/2015 Ackermann et al.
9,587,361 B2 * 3/2017 Oetken ..... E02D 3/0265
10,443,201 B2 * 10/2019 Meindl ..... E02D 3/026
2003/0026657 A1 2/2003 Gasper et al.
2003/0048082 A1 * 3/2003 Gandrud ..... G01H 9/00 318/128
2006/0034657 A1 2/2006 John Rio et al.
2007/0150147 A1 6/2007 Rasmussen et al.
2016/0076205 A1 * 3/2016 Corcoran ..... E02D 3/026 73/784

FOREIGN PATENT DOCUMENTS

CN 102839590 A 12/2012
CN 102985616 A 3/2013
CN 104831602 A 8/2015
DE 1634246 A1 7/1970
WO 2010072316 A1 7/2010

OTHER PUBLICATIONS

Chinese First Office Action dated Feb. 1, 2021 for Chinese Patent Application No. 201780088640.4, 13 pages (including English translation).
Extended European Search Report dated Jan. 12, 2021 for European Patent Application No. 17902132.4, 8 pages.

* cited by examiner

VIBRATORY COMPACTION MACHINES PROVIDING COORDINATED IMPACTS FROM FIRST AND SECOND DRUMS AND RELATED CONTROL SYSTEMS AND METHODS

CROSS REFERENCE TO RELATED APPLICATIONS

This application is a 35 U.S.C. § 371 national stage application of PCT International Application No. PCT/US2017/023289 filed on Mar. 21, 2017, the disclosure and content of which is incorporated by reference herein in its entirety.

TECHNICAL FIELD

The present disclosure relates to the field of compaction machines, and more particularly, to vibratory compaction machines and related control systems and methods.

BACKGROUND

A compaction machine may include a chassis and two vibrating drums rotatably mounted to the chassis so that the drums compact a work surface (e.g., an asphalt mat) as the compaction machine moves thereon. A compaction machine may include eccentric masses (also referred to as eccentric shafts) in the respective drums that are rotated at speed to generate vibrations that are transmitted as impacts by the drums to the work surface. Various examples of compaction machines are discussed, for example, in U.S. Pat. No. 3,871,788 entitled "Vibrating Roller," U.S. Pat. No. 7,674,070 entitled "Vibratory System For Compactor Vehicles," and U.S. Publication No. 2003/0026657 entitled "Apparatus And Method For Controlling the Start Up And Phase Relationship Between Eccentric Assemblies."

Notwithstanding known compaction machines, there continues to exist a need in the art for compaction machines, methods, and/or controllers providing increased efficiency of operation and/or improved compaction.

SUMMARY

According to some embodiments of inventive concepts, a vibratory compaction machine includes a chassis, first and second drums rotatably mounted to the chassis to allow rotation of the first and second drums over a work surface, first and second vibration mechanisms, and a vibration controller. The first vibration mechanism is configured to generate vibrations that are transmitted as impacts by the first drum to the work surface, and the second vibration mechanism is configured to generate vibrations that are transmitted as impacts by the second drum to the work surface. The vibration controller is configured to control at least one of the first and second vibration mechanisms so that a first pattern of impacts transmitted to the work surface by the first drum and a second pattern of impacts transmitted to the work surface by the second drum are coordinated as the compaction machine moves over the work surface.

According to other embodiments of inventive concepts, a vibration control system is provided for a compaction machine. The compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface. The vibration control system includes a vibration controller configured to control at least one of the first and second vibration mechanisms so that a first pattern of impacts transmitted to the work surface by the first drum and a second pattern of impacts transmitted to the work surface by the second drum are coordinated as the compaction machine moves over the work surface.

According to still other embodiments of inventive concepts, a method is provided to control vibration in a compaction machine. The compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface. The method includes controlling at least one of the first and second vibration mechanisms so that a first pattern of impacts transmitted to the work surface by the first drum and a second pattern of impacts transmitted to the work surface by the second drum are coordinated as the compaction machine moves over the work surface.

ASPECTS

According to one aspect, a vibratory compaction machine includes a chassis, first and second drums rotatably mounted to the chassis to allow rotation of the first and second drums over a work surface, first and second vibration mechanisms, and a vibration controller. The first vibration mechanism is configured to generate vibrations that are transmitted as impacts by the first drum to the work surface, and the second vibration mechanism is configured to generate vibrations that are transmitted as impacts by the second drum to the work surface. The vibration controller is configured to control at least one of the first and second vibration mechanisms so that a first pattern of impacts transmitted to the work surface by the first drum and a second pattern of impacts transmitted to the work surface by the second drum are coordinated as the compaction machine moves over the work surface.

Impact positions of the second pattern of impacts transmitted to the work surface may be offset with respect to impact positions of the first pattern of impacts transmitted to the work surface. For example, the first and second patterns of impacts may be coordinated with respect to a section of the work surface so that the impact positions of the second pattern of impacts on the section of the work surface are offset with respect to the impact positions of the first pattern of impacts on the section of the work surface once both of the first and second drums have traversed the section of the work surface. Moreover, the impact positions of the second pattern on the section of the work surface are interleaved with respect to the impact positions of the first pattern on the section of the work surface.

The vibratory compaction machine may also include a drive motor coupled with at least one of the first and second drums to propel the compaction machine over the work surface. The first vibration mechanism may include a first eccentric mass mounted inside the first drum, and a first vibration motor coupled with the first eccentric mass wherein the first vibration motor is configured to spin the first eccentric mass inside the first drum to generate the vibrations that are transmitted as the impacts by the first drum to the work surface. The second vibration mechanism may include a second eccentric mass mounted inside the second drum, and a second vibration motor coupled with the second eccentric mass wherein the second vibration motor is configured to spin the second eccentric mass inside the second drum to generate the vibrations that are transmitted as the impacts by the second drum to the work surface. In addition, the vibration controller may be configured to coordinate the first and second patterns of impacts responsive to at least one of a phase of the first eccentric mass, a frequency of rotation of the first eccentric mass, a phase of the second eccentric mass, a frequency of rotation of the second eccentric mass, a speed of the compaction machine over the work surface, a distance traversed by the compaction machine over the work surface, a center to center distance between the first and second drums, and sizes of the first and second drums.

The controller is further configured to adjust relative rotational phases of the first and second eccentric masses while coordinating the first and second patterns of impacts transmitted to the work surface by adjusting at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

The controller may be further configured to maintain an offset of rotational phases of the first and second eccentric masses while coordinating the first and second patterns of impacts transmitted to the work surface by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

The controller may be configured to coordinate the first pattern of impacts and the second pattern of impacts by setting operational parameters of the first vibration mechanism to provide the first pattern of impacts transmitted to the work surface by the first drum as a baseline, and adjusting operational parameters of the second vibration mechanism responsive to the baseline to provide the second pattern of impacts transmitted to the work surface.

According to another aspect, a vibration control system is provided for a compaction machine. The compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface. The vibration control system includes a vibration controller configured to control at least one of the first and second vibration mechanisms so that a first pattern of impacts transmitted to the work surface by the first drum and a second pattern of impacts transmitted to the work surface by the second drum are coordinated as the compaction machine moves over the work surface.

Impact positions of the second pattern of impacts transmitted to the work surface may be offset with respect to impact positions of the first pattern of impacts transmitted to the work surface. For example, the first and second patterns of impacts may be coordinated with respect to a section of the work surface so that the impact positions of the second pattern of impacts on the section of the work surface are offset with respect to the impact positions of the first pattern of impacts on the section of the work surface once both of the first and second drums have traversed the section of the work surface. Moreover, the impact positions of the second pattern on the section of the work surface may be interleaved with respect to the impact positions of the first pattern on the section of the work surface.

The compaction machine may further include a drive motor coupled with at least one of the first and second drums to propel the compaction machine over the work surface. The first vibration mechanism may include a first eccentric mass mounted inside the first drum, and a first vibration motor coupled with the first eccentric mass wherein the first vibration motor is configured to spin the first eccentric mass inside the first drum to generate the vibrations that are transmitted as the impacts by the first drum to the work surface. The second vibration mechanism may include a second eccentric mass mounted inside the second drum, and a second vibration motor coupled with the second eccentric mass wherein the second vibration motor is configured to spin the second eccentric mass inside the second drum to generate the vibrations that are transmitted as the impacts by the second drum to the work surface. The vibration controller may be configured to coordinate the first and second patterns of impacts responsive to at least one of a phase of the first eccentric mass, a frequency of rotation of the first eccentric mass, a phase of the second eccentric mass, a frequency of rotation of the second eccentric mass, a speed of the compaction machine over the work surface, a distance traversed by the compaction machine over the work surface, a center to center distance between the first and second drums, and sizes of the first and second drums.

The vibration controller may be further configured to adjust relative rotational phases of the first and second eccentric masses while coordinating the first and second patterns of impacts transmitted to the work surface by adjusting at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

The controller may be further configured to maintain an offset of rotational phases of the first and second eccentric masses while coordinating the first and second patterns of impacts transmitted to the work surface by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

The controller may be configured to coordinate the first pattern of impacts and the second pattern of impacts by setting operational parameters of the first vibration mechanism to provide the first pattern of impacts transmitted to the work surface by the first drum as a baseline, and adjusting operational parameters of the second vibration mechanism responsive to the baseline to provide the second pattern of impacts transmitted to the work surface.

According to still another aspect, a method is provided to control vibration in a compaction machine. The compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface. The method includes controlling at least one of the first and second vibration mechanisms so that a first pattern of impacts transmitted to the work surface by the first drum and a second pattern of impacts transmitted to the work surface by the second drum are coordinated as the compaction machine moves over the work surface.

Impact positions of the second pattern of impacts transmitted to the work surface may be offset with respect to impact positions of the first pattern of impacts transmitted to the work surface. For example, the first and second patterns of impacts may be coordinated with respect to a section of the work surface so that the impact positions of the second pattern of impacts on the section of the work surface are offset with respect to the impact positions of the first pattern of impacts on the section of the work surface once both of the first and second drums have traversed the section of the work surface. Moreover, the impact positions of the second pattern on the section of the work surface may be interleaved with respect to the impact positions of the first pattern on the section of the work surface.

The compaction machine may further include a drive motor coupled with at least one of the first and second drums to propel the compaction machine over the work surface. The first vibration mechanism may include a first eccentric mass mounted inside the first drum, and a first vibration motor coupled with the first eccentric mass wherein the first vibration motor is configured to spin the first eccentric mass inside the first drum to generate the vibrations that are transmitted as the impacts by the first drum to the work surface. The second vibration mechanism may include a second eccentric mass mounted inside the second drum, and a second vibration motor coupled with the second eccentric mass wherein the second vibration motor is configured to spin the second eccentric mass inside the second drum to generate the vibrations that are transmitted as the impacts by the second drum to the work surface. Moreover, controlling may include coordinating the first and second patterns of impacts responsive to at least one of a phase of the first eccentric mass, a frequency of rotation of the first eccentric mass, a phase of the second eccentric mass, a frequency of rotation of the second eccentric mass, a speed of the compaction machine over the work surface, a distance traversed by the compaction machine over the work surface, a center to center distance between the first and second drums, and sizes of the first and second drums.

In addition, the method may include adjusting relative rotational phases of the first and second eccentric masses while coordinating the first and second patterns of impacts transmitted to the work surface by adjusting at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

The method may also include maintaining an offset of rotational phases of the first and second eccentric masses while coordinating the first and second patterns of impacts transmitted to the work surface by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

Moreover, coordinating the first pattern of impacts and the second pattern of impacts may include setting operational parameters of the first vibration mechanism to provide the first pattern of impacts transmitted to the work surface by the first drum as a baseline, and adjusting operational parameters of the second vibration mechanism responsive to the baseline to provide the second pattern of impacts transmitted to the work surface.

Other compaction machines, control systems, and methods according to aspects or embodiments will be or become apparent to those with skill in the art upon review of the following drawings and detailed description. It is intended that all such additional compaction machines, control systems, and methods be included within this description and protected by the accompanying claims. Moreover, it is intended that all aspects and embodiments disclosed herein can be implemented separately or combined in any way and/or combination.

BRIEF DESCRIPTION OF THE DRAWINGS

The accompanying drawings, which are included to provide a further understanding of the disclosure and are incorporated in a constitute a part of this application, illustrate certain non-limiting embodiments of inventive concepts. In the drawings.

DETAILED DESCRIPTION

Inventive concepts will now be described more fully hereinafter with reference to the accompanying drawings, in which examples of embodiments of inventive concepts are shown. Inventive concepts may, however, be embodied in many different forms and should not be construed as limited to the embodiments set forth herein. Rather, these embodiments are provided so that this disclosure will be thorough and complete, and will fully convey the scope of present inventive concepts to those skilled in the art. It should also be noted that these embodiments are not mutually exclusive. Components from one embodiment may be tacitly assumed to be present/used in another embodiment. Any two or more embodiments described below may be combined in any way with each other. Moreover, certain details of the described embodiments may be modified, omitted, or expanded upon without departing from the scope of the described subject matter.

Figure 1:
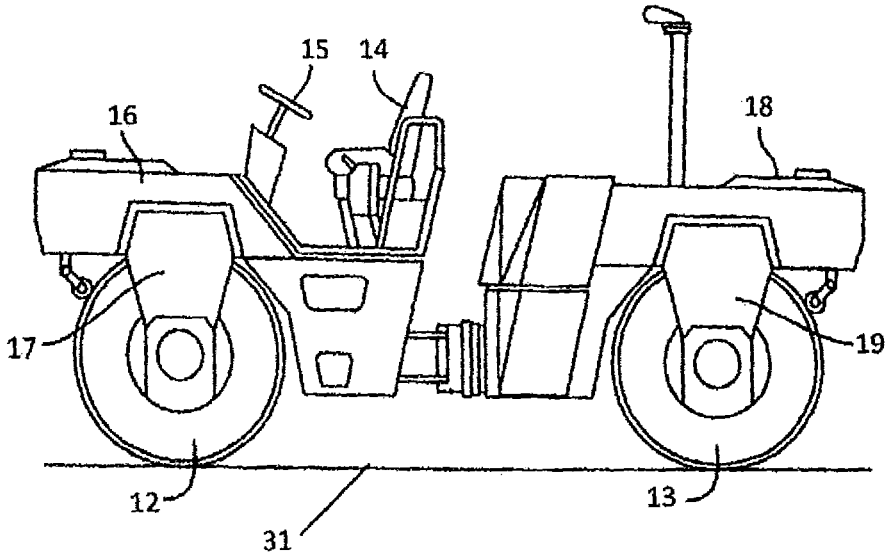
FIG. 1 is a side view of a compaction machine according to some embodiments of inventive concepts.

FIG. 1 illustrates a self-propelled compaction machine according to some embodiments of inventive concepts. The compaction machine of FIG. 1 may include a chassis 16, 18, first (e.g., leading) and second (e.g., trailing) rotatable drums 12 and 13 at the front and back at of the chassis 16, 18, and a driver station including a seat 14 and a steering mechanism 15 (e.g., a steering wheel) to provide driver control of the compaction machine. Moreover, each drum may be coupled to the chassis 16, 18 using a respective frame 17, 19 (also referred to as a yoke). One or both of the drums 12, 13 may be driven by a drive motor over a work surface 31.

Figure 2:
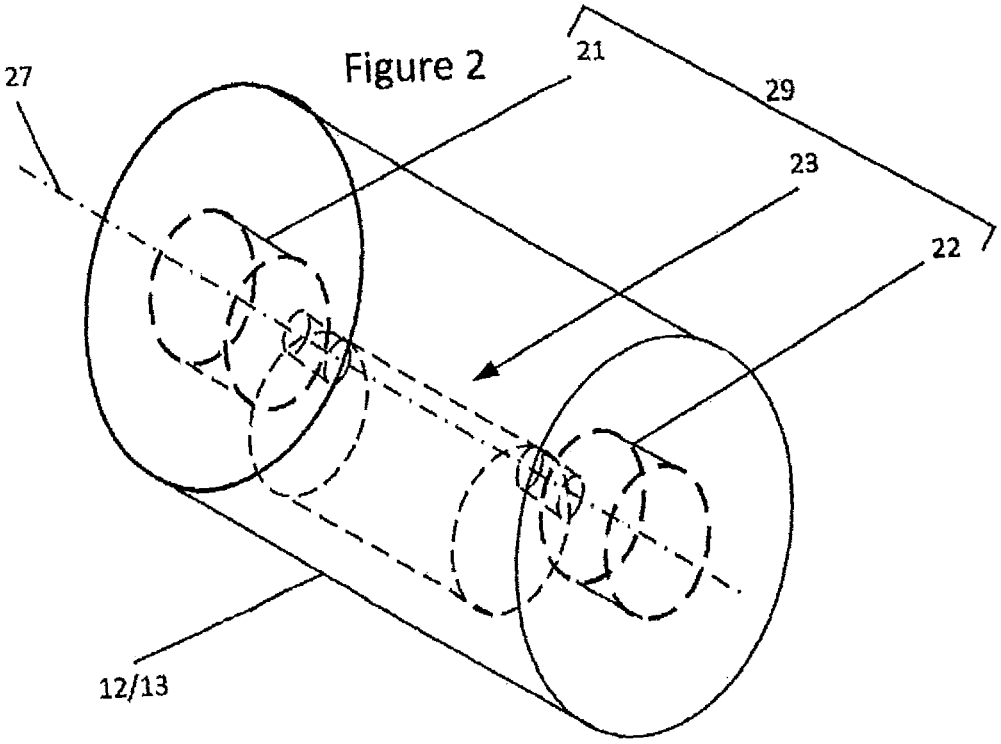
FIG. 2 is a perspective view of a drum of the compaction machine of FIG. 1 including a vibration motor and eccentric assembly according to some embodiments of inventive concepts.

Each of drums 12 and 13 also includes a vibration mechanism 29. Within the scope of the present embodiment the vibration mechanism 29 may be any device or devices, such as, for example, a variety of eccentric rotating mass systems, linear resonant actuator systems, etc., that are capable of generating vibrations transmitted as impacts by the first and second drums 12 and 13 to the work surface 31. By way of example, the vibration mechanism 29 may be provided using: one eccentric assembly including a single eccentric shaft (single amplitude machine); one eccentric assembly including two eccentric shafts (multiple amplitude machine); multiple eccentric assemblies including single and/or double eccentric shaft systems (oscillatory machines); or using a linear actuator moving a mass at a speed to achieve similar vibration characteristics. Those of ordinary skill in the art will appreciate that numerous vibration mechanisms are known, and the scope of the present embodiment is not limited to the particular vibration system 29 illustrated. While lesser or more complex eccentric systems may be employed within the scope of the present embodiment, for the sake of simplicity and brevity, FIG. 2, shows a relatively simple vibration mechanism 29 that includes a single rotatable eccentric mass 23, which may, for example, be driven by an eccentric motor 21 and supported by a mounting assembly 22. Those of ordinary skill in the art will appreciate that the center of mass of the eccentric mass 23 is imbalanced and does not reside on the rotational axis 27 about which the eccentric mass 23 rotates. Those of ordinary skill in the art will also appreciate that, for purposes of increasing compaction efficiency, the imbalanced nature of the eccentric mass 23 of each drum 12, 13 imparts vibration to the drums 12, 13 as the eccentric mass rotates about rotational axis 27. Those of ordinary skill in the art will also appreciate that as the eccentric mass 23 rotates that the eccentric mass 23 generates a downward force that is transmitted as an impact by the drums 12, 13 to the work surface 31 Furthermore, those of ordinary skill in the art will appreciate that as the eccentric mass 23 rotates, the eccentric mass also generates an upward force which urges the drums 12, 13 upward, relative to the occurrence of a downward impact force.

In a conventional compaction machine, front and rear drums may vibrate independently. Accordingly, impacts may be inefficiently delivered by the front and rear drums over a same section of asphalt. If impacts are delivered by the front and rear drums at the same locations over a section of asphalt, for example, uneven compaction may occur requiring more passes of the compaction machine to achieve a desired uniformity and/or density of the asphalt, thereby reducing efficiency. Moreover, insufficient control of the vibrations of the front and rear drums may result in increased vibration through the chassis, potentially causing durability issues with respect to the compaction machine and/or components thereof.

Impacts per foot is one parameter used to measure machine performance. During operation, each eccentric mass may be rotated to generate vibrations transmitted as impacts by the first and second drums 12 and 13 to the work surface 31 The frequency of impacts and the compaction machine travel speed together determine the impacts per foot for each drum, which may strongly influence a number of passes the compaction machine must make over a given section of asphalt (also referred to as a patch or length of asphalt) to achieve a desired density of the asphalt. Each drum, for example, may deliver in the range of 5 to 20 impacts per foot (so that positions/locations of consecutive impacts of a drum are spaced 2.40 to 0.60 inches across the asphalt), and more particularly, in the range of 10 to 14 impacts per foot (so that positions/locations of consecutive impacts are spaced in the range of 1.20 to 0.86 inches across the asphalt). With current vibratory drum system designs, a lack of coordination between positions/locations of impact delivered by the two drums may result in additional passes.

According to some embodiments of inventive concepts, a control system may be provided to coordinate impacts of the first and second drums to allow tuning for improved performance and/or efficiency. Moreover, relative phases of the eccentric masses may be adjusted while coordinating impacts to reduce vibrations transmitted through the chassis. In order to adjust relative phases of the eccentric masses while maintaining coordination of leading and trailing drum impact patterns, relative offsets between leading and trailing drum impact patterns may be adjusted, speed of the compaction machine may be adjusted, and/or frequencies of rotation of the leading and trailing eccentric masses may be adjusted.

As discussed herein, a pattern of impacts refers to a pattern of impact positions on an asphalt mat (or other work surface 31) at which a vibratory compaction drum delivers impacts to the asphalt mat due to vibrations caused by the rotating eccentric mass. Moreover, first (e.g., leading) drum 12 and second (e.g., trailing) drum 13 of a vibratory compaction machine will deliver respective first and second patterns of impacts to a same section of asphalt at different times because the leading and trailing drums pass over the section of asphalt at different times. According to some embodiments of inventive concepts disclosed herein, impact positions of the second pattern of impacts from the second drum 13 may be offset and interleaved with respect to impacts from the first drum 12 over the section of asphalt even though the first and second drums 12 and 13 traverse the section of asphalt at different times.

By deliberately tuning vibrations of the drums (e.g., by controlling frequencies of rotation of the respective eccentric masses, phases of rotation of eccentric masses, speed of the compaction machine, etc.), impact positions of the trailing drum 13 may be shifted slightly or offset with respect to impact positions of the leading drum 12 over the same section of asphalt after both drums have passed over that section of asphalt, while both drums deliver a same number of impacts per unit length (e.g., impacts per foot). For example, impacts of the trailing drum 13 may be controlled to hit peaks (areas of lesser density) that were left behind by the leading drum 12. Stated in other words, vibrations of the drums may be coordinated/controlled so that positions of impact (also referred to as locations of impact) of the trailing drum 13 on the asphalt may be controlled to fall between positions of impact of the leading drum on the asphalt.

Figure 3:
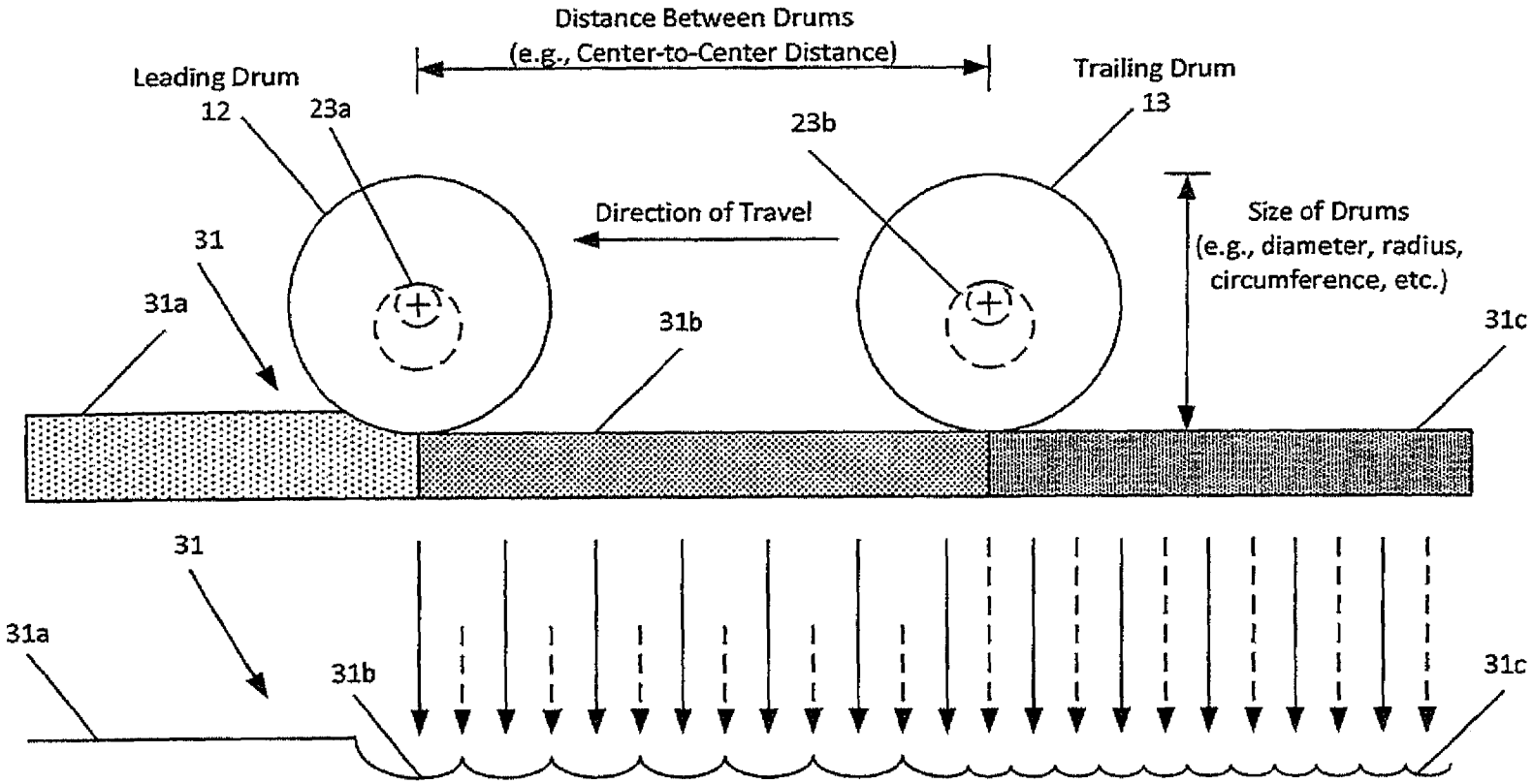
FIG. 3 is a diagram illustrating compaction using a compaction machine having two drums according to some embodiments of inventive concepts.

FIG. 3 is a diagram where the upper section illustrates leading and trailing drums 12 and 13 compacting a work surface 31 such as an asphalt mat, and the lower section of the diagram illustrates a representation of the work surface 31 of the asphalt mat zoomed in significantly to show fine detail of the working surface that may result from a particular impacts per unit length (e.g., "impacts per foot") machine performance. By coordinating impacts from the leading and trailing drums 12 and 13 as shown in FIG. 3, the compaction machine may provide a desired density/uniformity of the asphalt in fewer passes thereby improving efficiency, productivity, and/or a quality of the resulting asphalt. An average density of the asphalt is represented in FIG. 3 by the different dot densities in sections 31*a*, 31*b*, and 31*c* of the asphalt mat. While not indicated by the dot pattern of section 31*b*, a periodic variation in density may occur after the leading drum 12 passes, with areas of higher density occurring at positions most directly impacted by the leading drum 12 (indicated by solid line arrows and also referred to as impact positions or positions of impact) and with areas of lower density occurring between these positions of most direct impact. In section 31*c*, these periodic density variations may be reduced after passage of both leading and trailing drums 12 and 13 by coordinating impacts of the drums.

As the compaction machine moves from right to left across the asphalt mat work surface 31 in FIG. 3, leading drum 12 provides a first phase of compaction indicated by the change in density from section 31*a* (not yet compacted by the leading drum 12) to section 31*b* of the asphalt mat work surface 31 (compacted by the leading drum 12 but not the trailing drum 13), and trailing drum 13 provides a second phase of compaction indicated by the change in density from section 31*b* to 31*c* (compacted by both leading and trailing drums 12 and 13) of the asphalt mat work surface 31. The solid line arrows at the bottom of FIG. 3 indicate positions of impact of the leading drum 12 on sections 31*b* and 31*c* of the asphalt mat work surface 31. The longer dashed line arrows at the bottom of FIG. 3 indicate positions of impact of the trailing drum 13 on section 31*c* the asphalt mat work surface (that have been compacted by the trailing drum 13), and the shorter dashed line arrows indicate intended positions of impact of the trailing drum 13 on section 31*b* of the asphalt mat work surface (not yet compacted by the trailing drum 13).

As shown in FIG. 3, vibrations of at least one of the leading and trailing drums 12 and 13 may thus be controlled so that a first pattern of impacts transmitted to the asphalt mat work surface 31 by the leading drum 12 and a second pattern of impacts transmitted to the asphalt mat work surface 31 by the trailing drum 13 are coordinated as the compaction machine moves over the work surface 31. More particularly, the patterns of impacts from the leading and trailing drums 12 and 13 may be coordinated so that impacts of the trailing drum 13 are offset and/or interleaved with respect to impacts of the leading drum 12 over section 31*c* of the asphalt mat work surface 31 that has been traversed by both leading and trailing drums 12 and 13 as shown in FIG. 3.

Impact positions of the leading drum 12 indicated with solid line arrows and impact positions of the trailing drum 13 indicated with longer dashed line arrows over section 31*c* may thus be interleaved and offset in a pattern as shown in FIG. 3 over a section 31*c* of the asphalt mat work surface 31 having a certain length. As discussed above, each drum may deliver in the range of 5 to 20 impacts per foot (so that impacts from a same drum are spaced 2.40 to 0.60 inches across the asphalt), and more particularly, in the range of 10 to 14 impacts per foot (so that impacts of each drum are spaced 1.20 to 0.86 inches across the asphalt). At 5 impacts per foot, impact positions from trailing drum 13 may be spaced in the range of about 0.5 to 1.9 inches relative to adjacent impact positions from leading drum; at 10 impacts per foot, impact positions from trailing drum 13 may be spaced in the range of about 0.3 to 0.9 inches from adjacent impact positions from leading drum 12; at 14 impacts per foot, impact positions from trailing drum 13 may be spaced by about 0.2 to 0.7 inches from adjacent impact positions from leading drum 12; and at 20 impacts per foot, impact positions from trailing drum 13 may be spaced by about 0.2 to 0.4 inches from adjacent impact positions from leading drum 12.

As shown in FIG. 3, impact positions from trailing drum 13 may be substantially centered between adjacent impact positions from leading drum 12 after both drums have traversed section 31*c* of the asphalt mat. According to some other embodiments, impact positions from trailing drum may be shifted from a center position between adjacent impact positions from the leading drum. According to some other embodiments, impact positions of leading and trailing drums 12 and 13 may be coordinated to coincide.

In greater detail, section 31*a* of the asphalt mat work surface 31 has not been compacted by either drum, section 31*b* of the asphalt mat work surface 31 has been compacted by the leading drum 12 but not the trailing drum 13, and section 31*c* of the asphalt mat work surface 31 has been compacted by both the leading and trailing drums 12 and 13. Based on the speed of the compaction machine and vibrations generated by rotation of eccentric mass 23*a*, leading drum 12 may generate impacts at locations on the asphalt mat work surface 31 indicated by the solid line arrows. Over section 31*b* of the asphalt mat work surface 31 where only the leading drum 12 has passed, variations in density and/or surface (e.g., peaks and valleys) may occur as indicated by the representation of the asphalt mat work surface below the arrows. To reduce these variations, vibrations of the trailing drum 13 may be controlled so that impact positions of the trailing drum 13 will occur between previous impact positions of the leading drum 12. For example, impacts of the trailing drum 13 may occur at surface peaks left by the leading drum 12 and/or at regions of lower asphalt density left by the leading drum 12. The shorter dashed line arrows for section 31*b* indicate intended impacts of the trailing drum 13. According to some embodiments, impact locations of the trailing drum 13 may be evenly spaced between impact locations of the leading drum 12 to reduce variations in density and/or surface peaks/valleys.

For section 31*c* where both the leading and trailing drums 12 and 13 have passed, the solid line arrows indicate impact positions from the leading drum 12 on the asphalt mat work surface and the longer dashed line arrows indicate impact positions from the trailing drum 13 on the asphalt mat work surface. As shown, the impact positions of the trailing drum 13 may be arranged between the impact positions of the leading drum 12 on the section 31*c* of the asphalt mat work surface 31 where both leading and trailing drums have passed. Over section 31*c* of the asphalt mat work surface 31, variations in density and/or surface (e.g., peaks and valleys) may be reduced as indicated by the representation of the asphalt surface below the arrows. By offsetting and interleaving impact positions of the leading and trailing drums 12 and 13, a uniformity of asphalt density and/or surface may be improved.

Figure 4:
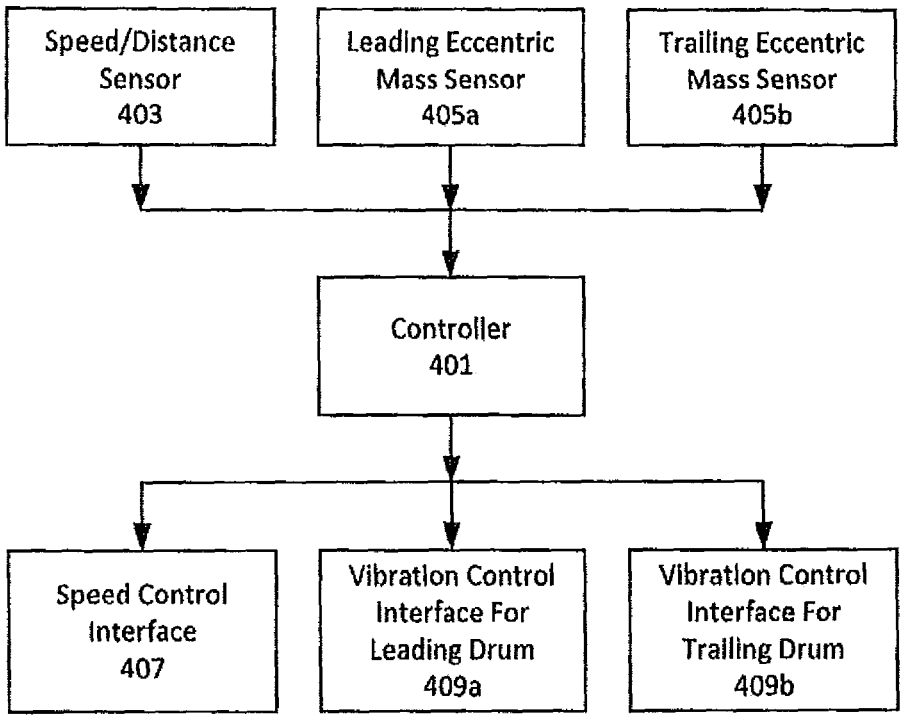
FIG. 4 is a block diagram illustrating a vibration control system for a compaction machine according to some embodiments of inventive concepts.

A control system of FIG. 4 may include controller 400 configured to coordinate patterns of impacts delivered by leading and trailing drums 12 and 13 as discussed above with respect to FIG. 3 responsive to at least one of a phase of the first eccentric mass, a frequency of rotation of the first eccentric mass, a phase of the second eccentric mass, a frequency of rotation of the second eccentric mass, a speed of the compaction machine over the work surface 31, a center to center distance between the first and second drums, and sizes (e.g., diameter, radius, circumference, etc.) of the leading and trailing drums 12 and 13. As shown in FIG. 4, controller 401 inputs may be coupled to a speed/distance sensor 403 (e.g., coupled with a drum and/or Global Positioning System GPS receiver) providing information regarding speed of the compaction machine and/or distance traveled across the asphalt mat work surface 31, a leading eccentric mass sensor 405*a* providing information regarding a frequency and phase of rotation of leading eccentric mass 23*a*, and a trailing eccentric mass sensor 405*b* providing information regarding a frequency and phase of rotation of trailing eccentric mass 23*b*. In addition, controller 401 outputs may be coupled with speed control interface 407 (e.g., coupled with the drive motor) to control a speed of the compaction machine across the asphalt mat work surface 31, a vibration control interface 409*a* (e.g., coupled with the vibration motor for the leading eccentric mass) for leading drum 12 to control a frequency and phase of rotation of eccentric mass 23*a*, and a vibration control interface 409*b* (e.g., coupled with the vibration motor for the trailing eccentric mass) for trailing drum 13 to control a frequency and phase of rotation of eccentric mass 23*b*. While sensors and control interfaces are shown in FIG. 4 separate from controller 401, one or more of the sensors and/or control interfaces of FIG. 4 or portions thereof may be incorporated in controller 401.

Eccentric mass sensors 405*a* and 405*b* (e.g., coupled with the respective vibration motors) may thus provide phase positions of eccentric masses 23*a* and 23*b* to be used by controller 401 to coordinate impact patterns of leading and trailing drums 12 and 13. In a single amplitude machine (with a single eccentric mass in each drum) as shown in FIG. 2, a single index may be used by eccentric mass sensors 405*a* and 405*b* to determine phases of respective eccentric masses. In a multiple amplitude machine, an eccentric mass assembly may spin with the inner and outer eccentric masses in different orientations to provide different amplitudes of vibration. Accordingly, an eccentric mass sensor may be configured to generate phase information regarding the respective orientations/amplitudes based on different indexing. Sensing in multiple amplitude machines is discussed by way of example in U.S. Pat. No. 7,674,070, the disclosure of which is hereby incorporated herein in its entirety by reference. By coupling each eccentric mass to the respective vibration motor with a known orientation relative to the vibration motor, a respective eccentric mass sensor may determine both a frequency of rotation and a phase of rotation of the eccentric mass (e.g., a position of the eccentric mass) by monitoring a position/index of a rotor on the vibration motor.

Distance travelled while vibrations of leading and trailing drums 12 and 13 are turned on may be calculated continuously by speed/distance sensor 403 and thus known to controller 401. This information may use fixed machine geometry (e.g., drum diameter, center to center distance between drums, etc.) and operator inputs (e.g., travel speed) to produce and update the data used by controller 401.

Control logic of controller 401 may thus monitor and adjust machine parameters (e.g., machine speed, frequency/phase of rotation of leading drum, frequency/phase of rotation of trailing drum, space between impacts of each drum on the working surface, offsets between impacts of leading and trailing drums, etc.) to achieve a desired performance in terms of impact coordination between leading and trailing drums, impacts per unit length (e.g., impacts per foot), impact amplitude, vibration, etc.

According to some embodiments, leading drum 12 may be set as a master or baseline from which other parameters may be adjusted. In such a system, trailing drum 13 may be set as a slave so that parameters of the trailing drum 13 (e.g., rotational frequency/phase of eccentric mass 23*b*) may be adjusted to achieve a desired coordination of impact patterns of leading and trailing drums 12 and 13. According to some other embodiments, trailing drum 13 may be set as a master, and leading drum 12 may be set as a slave so that parameters of the leading drum 12 may be adjusted to achieve a desired coordination. Moreover, the compaction machine may operate in both forward and in reverse so that one drum is set as the master when the compaction machine travels in one direction (e.g., forward) and the other drum is set as the master when the compaction machine travels in the other direction (e.g., reverse).

According to some embodiments of inventive concepts, impacts and/or vibrations of the leading and trailing drums may be coordinated to provide improved performance, efficiency, and/or quality of asphalt. By controlling phases of impacts delivered by the leading and trailing drums, the trailing drum may be controlled to compact targeted zones in the asphalt mat work surface that were missed by the leading drum, thereby allowing for fewer compaction machine passes to achieve a desired asphalt density. Moreover, by coordinating machine speed with the coordinated impact patterns of the leading and trailing drums (e.g., space between adjacent impact locations of each drum on the asphalt mat, an offset between impact patterns of the two drums, etc.), a desired phase relationship between eccentric masses may be achieved to reduce vibrations coupled into the chassis of the machine.

Figure 5:
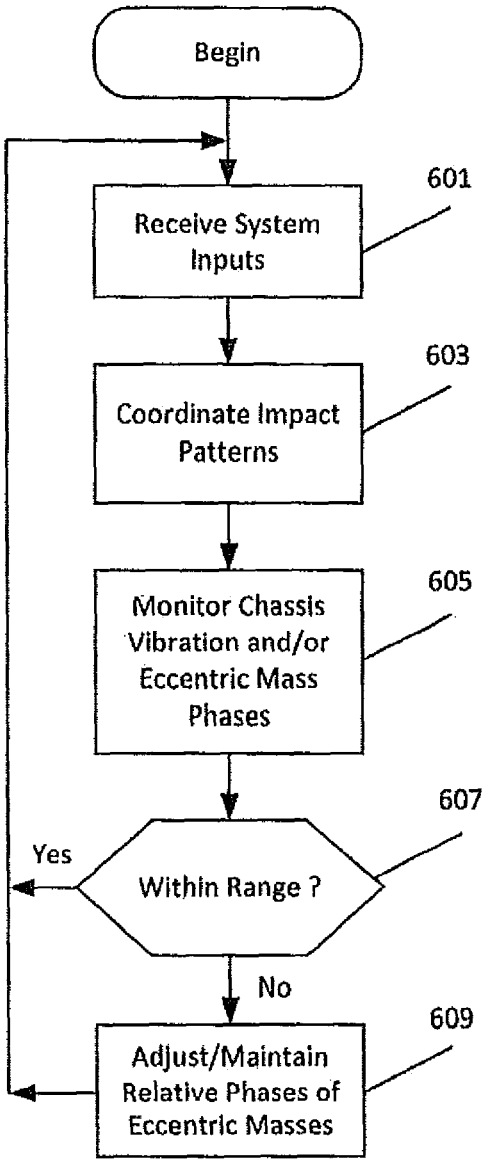
FIGS. 5 and 6 are flow diagrams illustrating operations of the controller of FIG. 4 according to some embodiments of inventive concepts.

Operations of controller 401 will now be discussed with reference to the flow charts of FIGS. 5 and 6. At block 601, controller 401 may receive system inputs from speed/distance sensor 403 (providing a speed of and/or distance traveled by compaction machine over the work surface 31), leading eccentric mass sensor 405*a* (providing a frequency and/or phase of rotation of eccentric mass 23*a*), and trailing eccentric mass sensor 405*b* (providing a frequency and/or phase of rotation of eccentric mass 23*b*). Responsive to these system inputs and responsive to machine parameters (e.g., center to center distance of leading and trailing drums, sizes of first and second drums, etc.) at block 603, controller 401 may coordinate a first pattern of impacts transmitted to the work surface 31 (e.g., an asphalt mat work surface) by the leading drum 12 and a second pattern of impacts transmitted to the work surface 31 (e.g., an asphalt mat work surface) by the trailing drum 13 by controlling at least one of rotational frequency/phase of eccentric mass 23*a* via vibration control interface 409*a* and vibration motor 21*a*, rotational frequency/phase of eccentric mass 23*b* via vibration control interface 409*b* and vibration motor 21*b*, and/or speed of the compaction machine via speed control interface 407 as the compaction machine moves over the work surface 31.

Figure 6:
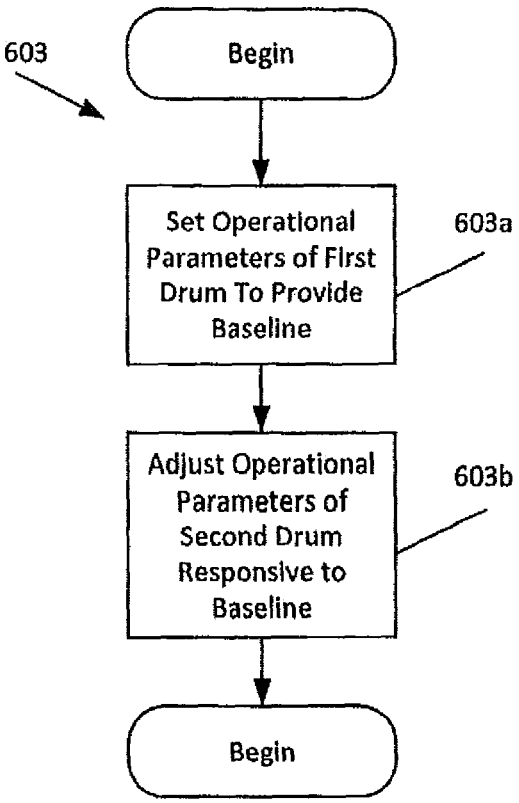

According to some embodiments, operations of coordinating impact patterns at block 603 may be performed as discussed with respect to blocks 603*a* and 603*b* of FIG. 6. At block 603*a*, controller 401 may be configured to set operational parameters of eccentric mass 23*a* and/or associated vibration motor 21*a* to provide the first pattern of impacts transmitted to the work surface 31 by the first drum as a baseline (including a spacing between positions of impacts delivered by the first drum) so that drum 12 is designated as the master. At block 603*b*, controller 401 may be configured to adjust operational parameters of eccentric mass 23*b* and/or associated vibration motor 21*b* responsive to the baseline to provide the second pattern of impacts transmitted to the work surface 31 (such that positions of impacts of the second pattern are offset relative to positions of impacts of the first pattern) so that drum 13 is designated as the slave. According to some embodiments, the leading drum 12 (with eccentric mass 23*a*) may thus be designated as a master, and the trailing drum (with eccentric mass 23*b*) may be designated as a slave. According to some other embodiments, the trailing drum 13 (with eccentric mass 23*b*) may be designated as a master, and the leading drum (with eccentric mass 23*a*) may be designated as a slave.

Operations of blocks 601 and 603 may thus provide an inner control loop coordinating impact patterns from leading and trailing drums 12 and 13. At block 605, controller 401 may monitor rotational phases of eccentric masses 23*a* and 23*b* and/or chassis vibration to maintain a desired phase offset and/or to reduce vibrations transmitted to the chassis. Responsive to monitoring at block 605, controller 401 may determine whether a phase offset between eccentric masses 23*a* and 23*b* is within a desired range and/or whether chassis vibrations are within a desired range. Provided that the rotational phases of eccentric masses 23*a* and 23*b* are within a desired range (e.g., that the phases are sufficiently offset) and/or that the chassis vibration is within a desired range (e.g., that chassis vibration is sufficiently low), controller 401 may continue operations of blocks 601 and 603.

Responsive to rotational phases of eccentric masses 23*a* and 23*b* falling outside the desired range (e.g., that the phases are not sufficiently offset) and/or chassis vibration falling outside the desired range (e.g., that the chassis vibration is too high) at block 607, controller 401 may adjust relative phases of eccentric masses 23*a* and 23*b* to provide a sufficient offset at block 609. Controller 401, for example, may adjust relative rotational phases of eccentric masses 23*a* and 23*b* at block 609 while coordinating the first and second patterns of impacts transmitted to the work surface 31 at blocks 601 and 603 by adjusting at least one of a speed of the vibratory compaction machine, a rotational frequency of the eccentric mass 23*a*, a rotational frequency of eccentric mass 23*b*, a distance between impacts of the first pattern delivered by leading drum 12 (i.e., adjusting impacts per unit length), and a distance between impacts of the second pattern delivered by trailing drum 13. Operations of blocks 605, 607, and 609 may thus provide an outer control look to provide that vibrations through the chassis do not exceed a desired threshold. Moreover, adjusting the relative phases may include adjusting the relative phases by adjusting a center-to-center distance between drums 12 and 13, for example, by adjusting an articulable coupling between front and rear portions 16 and 18 of the chassis.

According to some other embodiments, controller 401 may maintain an offset of rotational phases of the first and second eccentric masses at block 607. More particularly, controller 401 may maintain the offset of rotational phases while coordinating the first and second patterns of impacts transmitted to the work surface 31 by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns. Moreover, maintaining the relative phases may include maintaining the relative phases by adjusting a center-to-center distance between drums 12 and 13, for example, by adjusting and articulable coupling between front and rear portions 16 and 18 of the chassis.

Controller 401 may include a processor coupled with a memory and an interface circuit, and the interface circuit may provide communication between the processor and speed/distance sensor 403, the leading and trailing eccentric mass sensors 405*a-b*, the speed control interface 407, and the vibration control interfaces 409*a-b*. The processor may thus be configured to execute computer program code in the memory (described below as a non-transitory computer readable medium) to perform at least some of the operations discussed above with respect to FIGS. 5 and 6.

The control system of FIG. 4 may thus control timing of the eccentric mass of the trailing drum so that impact forces are applied at mat peaks corresponding to areas that were missed by the leading drum in a pass. Control logic of controller 401 may monitor machine performance and adjust the frequency and phasing of the eccentric mass of the trailing drum to time the impacts accordingly. The phase and frequency of the eccentric mass of the trailing drum may be controlled according to the phase and frequency of the eccentric mass on the leading drum, the drum diameter, the center-to-center distance between the drums, and the travel speed of the compaction machine. In addition to increasing compaction efficiency, the phase of the eccentric mass of the trailing drum may be controlled to reduce vibration induced fatigue by reducing/avoiding harmful drum phases (e.g., when phases of both eccentric masses are aligned).

In the above-description of various embodiments of the present disclosure, it is to be understood that the terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

When an element is referred to as being "connected", "coupled", "responsive", "mounted", or variants thereof to another element, it can be directly connected, coupled, responsive, or mounted to the other element or intervening elements may be present. In contrast, when an element is referred to as being "directly connected", "directly coupled", "directly responsive", "directly mounted" or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" and its abbreviation "/" include any and all combinations of one or more of the associated listed items.

It will be understood that although the terms first, second, third, etc. may be used herein to describe various elements/operations, these elements/operations should not be limited by these terms. These terms are only used to distinguish one element/operation from another element/operation. Thus a first element/operation in some embodiments could be termed a second element/operation in other embodiments without departing from the teachings of present inventive concepts. The same reference numerals or the same reference designators denote the same or similar elements throughout the specification.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Example embodiments are described herein with reference to block diagrams and/or flowchart illustrations of computer-implemented methods, apparatus (systems and/or devices) and/or computer program products. It is understood that a block of the block diagrams and/or flowchart illustrations, and combinations of blocks in the block diagrams and/or flowchart illustrations, can be implemented by computer program instructions that are performed by one or more computer circuits. These computer program instructions may be provided to a processor circuit of a general purpose computer circuit, special purpose computer circuit, and/or other programmable data processing circuit to produce a machine, such that the instructions, which execute via the processor of the computer and/or other programmable data processing apparatus, transform and control transistors, values stored in memory locations, and other hardware components within such circuitry to implement the functions/acts specified in the block diagrams and/or flowchart block or blocks, and thereby create means (functionality) and/or structure for implementing the functions/acts specified in the block diagrams and/or flowchart block(s).

These computer program instructions may also be stored in a tangible computer-readable medium that can direct a computer or other programmable data processing apparatus to function in a particular manner, such that the instructions stored in the computer-readable medium produce an article of manufacture including instructions which implement the functions/acts specified in the block diagrams and/or flowchart block or blocks. Accordingly, embodiments of present inventive concepts may be embodied in hardware and/or in software (including firmware, resident software, microcode, etc.) that runs on a processor such as a digital signal processor, which may collectively be referred to as "circuitry," "a module" or variants thereof.

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated. Finally, other blocks may be added/inserted between the blocks that are illustrated, and/or blocks/operations may be omitted without departing from the scope of inventive concepts. Moreover, although some of the diagrams include arrows on communication paths to show a primary direction of communication, it is to be understood that communication may occur in the opposite direction to the depicted arrows.

Persons skilled in the art will recognize that certain elements of the above-described embodiments may variously be combined or eliminated to create further embodiments, and such further embodiments fall within the scope and teachings of inventive concepts. It will also be apparent to those of ordinary skill in the art that the above-described embodiments may be combined in whole or in part to create additional embodiments within the scope and teachings of inventive concepts. Thus, although specific embodiments of, and examples for, inventive concepts are described herein for illustrative purposes, various equivalent modifications are possible within the scope of inventive concepts, as those skilled in the relevant art will recognize. Accordingly, the scope of inventive concepts is determined from the appended claims and equivalents thereof.

The invention claimed is:

1. A vibratory compaction machine comprising:

a chassis;

first and second drums rotatably mounted to the chassis to allow rotation of the first and second drums over a work surface;

a first vibration mechanism configured to generate vibrations that are transmitted as impacts by the first drum to the work surface;

a second vibration mechanism configured to generate vibrations that are transmitted as impacts by the second drum to the work surface; and a vibration controller configured to:

determine a first pattern of impacts based on a first configuration of the first vibration mechanism;

determine a second pattern of impacts based on a second configuration of the second vibration mechanism; and control at least one of a vibration speed and a phase of at least one of the first and second vibration mechanisms so that the first pattern of impacts transmitted to the work surface by the first drum and the second pattern of impacts transmitted to the work surface by the second drum are coordinated as the compaction machine moves over the work surface, wherein impact positions of the second pattern of impacts transmitted to the work surface are offset with respect to impact positions of the first pattern of impacts transmitted to the work surface.

2. The vibratory compaction machine of claim 1 wherein the controller is configured to coordinate the first pattern of impacts and the second pattern of impacts by, setting operational parameters of the first vibration mechanism to provide the first pattern of impacts transmitted to the work surface by the first drum as a baseline, and adjusting operational parameters of the second vibration mechanism responsive to the baseline to provide the second pattern of impacts transmitted to the work surface.

3. The vibratory compaction machine of claim 1 wherein the first and second patterns of impacts are coordinated with respect to a section of the work surface so that the impact positions of the second pattern of impacts on the section of the work surface are offset with respect to the impact positions of the first pattern of impacts on the section of the work surface once both of the first and second drums have traversed the section of the work surface.

4. The vibratory compaction machine of claim 3 wherein the impact positions of the second pattern on the section of the work surface are interleaved with respect to the impact positions of the first pattern on the section of the work surface.

5. The vibratory compaction machine of claim 1 further comprising:

a drive motor coupled with at least one of the first and second drums to propel the compaction machine over the work surface;

wherein the first vibration mechanism includes a first eccentric mass mounted inside the first drum, and a first vibration motor coupled with the first eccentric mass wherein the first vibration motor is configured to spin the first eccentric mass inside the first drum to generate the vibrations that are transmitted as the impacts by the first drum to the work surface;

wherein the second vibration mechanism includes a second eccentric mass mounted inside the second drum, and a second vibration motor coupled with the second eccentric mass wherein the second vibration motor is configured to spin the second eccentric mass inside the second drum to generate the vibrations that are transmitted as the impacts by the second drum to the work surface; and wherein the vibration controller is configured to coordinate the first and second patterns of impacts responsive to at least one of a phase of the first eccentric mass, a frequency of rotation of the first eccentric mass, a phase of the second eccentric mass, a frequency of rotation of the second eccentric mass, a speed of the compaction machine over the work surface, a distance traversed by the compaction machine over the work surface, a center to center distance between the first and second drums, and sizes of the first and second drums.

6. The vibratory compaction machine of claim 5 wherein the controller is further configured to adjust relative rotational phases of the first and second eccentric masses while coordinating the first and second patterns of impacts transmitted to the work surface by adjusting at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

7. The vibratory compaction machine of claim 5 wherein the controller is further configured to maintain an offset of rotational phases of the first and second eccentric masses while coordinating the first and second patterns of impacts transmitted to the work surface by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

8. A vibration control system for a compaction machine, wherein the compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface, the vibration control system comprising:

a vibration controller configured to control at least one of a vibration speed and a phase of at least one of the first and second vibration mechanisms to modify at least one of a first pattern of impacts transmitted to the work surface by the first drum and a second pattern of impacts transmitted to the work surface by the second drum, so that the first pattern of impacts and second pattern of impacts are coordinated as the compaction machine moves over the work surface;

wherein impact positions of the second pattern of impacts transmitted to the work surface are offset with respect to impact positions of the first pattern of impacts transmitted to the work surface.

9. The vibration control system of claim 8 wherein the first and second patterns of impacts are coordinated with respect to a section of the work surface so that the impact positions of the second pattern of impacts on the section of the work surface are offset with respect to the impact positions of the first pattern of impacts on the section of the work surface once both of the first and second drums have traversed the section of the work surface.

10. The vibration control system of claim 9 wherein the impact positions of the second pattern on the section of the work surface are interleaved with respect to the impact positions of the first pattern on the section of the work surface.

11. The vibration control system of claim 8, wherein the compaction machine further includes a drive motor coupled with at least one of the first and second drums to propel the compaction machine over the work surface, wherein the first vibration mechanism includes a first eccentric mass mounted inside the first drum, and a first vibration motor coupled with the first eccentric mass wherein the first vibration motor is configured to spin the first eccentric mass inside the first drum to generate the vibrations that are transmitted as the impacts by the first drum to the work surface, wherein the second vibration mechanism includes a second eccentric mass mounted inside the second drum, and a second vibration motor coupled with the second eccentric mass wherein the second vibration motor is configured to spin the second eccentric mass inside the second drum to generate the vibrations that are transmitted as the impacts by the second drum to the work surface, and wherein the vibration controller is configured to coordinate the first and second patterns of impacts responsive to at least one of a phase of the first eccentric mass, a frequency of rotation of the first eccentric mass, a phase of the second eccentric mass, a frequency of rotation of the second eccentric mass, a speed of the compaction machine over the work surface, a distance traversed by the compaction machine over the work surface, a center to center distance between the first and second drums, and sizes of the first and second drums.

12. The vibration control system of claim 11 wherein the vibration controller is further configured to adjust relative rotational phases of the first and second eccentric masses while coordinating the first and second patterns of impacts transmitted to the work surface by adjusting at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

13. The vibration control system of claim 11 wherein the controller is further configured to maintain an offset of rotational phases of the first and second eccentric masses while coordinating the first and second patterns of impacts transmitted to the work surface by controlling at least one of a speed of the vibratory compaction machine, a rotational frequency of the first eccentric mass, a rotational frequency of the second eccentric mass, a distance between impacts of the first pattern delivered by the first drum, a distance between impacts of the second pattern delivered by the second drum, and an offset between adjacent impacts of the first and second patterns.

14. The vibration control system of claim 8 wherein the controller is configured to coordinate the first pattern of impacts and the second pattern of impacts by, setting operational parameters of the first vibration mechanism to provide the first pattern of impacts transmitted to the work surface by the first drum as a baseline, and adjusting operational parameters of the second vibration mechanism responsive to the baseline to provide the second pattern of impacts transmitted to the work surface.

15. A method of controlling vibration in a compaction machine, wherein the compaction machine includes a chassis, first and second drums rotatably mounted to the chassis to allow rotation of the first and second drums over a work surface, a first vibration mechanism configured to generate vibrations that are transmitted as impacts by the first drum to the work surface, and a second vibration mechanism configured to generate vibrations that are transmitted as impacts by the second drum to the work surface, the method comprising:

determining a first pattern of impacts based on a first vibration speed and a first vibration phase of the first vibration mechanism;

determining a second pattern of impacts based on a second vibration speed and a second vibration phase of the second configuration of a second vibration mechanism; and controlling at least one of the first and second vibration mechanisms, the controlling comprising adjusting at least one of the first vibration speed, the first vibration phase, the second vibration speed, and the second vibration phase to modify at least one of the first pattern of impacts and the second pattern of impacts, so that the first pattern of impacts transmitted to the work surface by the first drum and the second pattern of impacts transmitted to the work surface by the second drum are coordinated as the compaction machine moves over the work surface, wherein impact positions of the second pattern of impacts transmitted to the work surface are offset with respect to impact positions of the first pattern of impacts transmitted to the work surface.

16. The method of claim 15, wherein determining the first pattern of impacts is further based on a movement speed of the compaction machine over the work surface, and wherein determining the second pattern of impacts is further based on the movement speed of the compaction machine over the work surface.

17. The method of claim 9, wherein controlling at least one of the first and second vibration mechanisms further comprises:

determining the impact positions of the first pattern of impacts and the impact positions of the second pattern of impacts based a movement speed of the compaction machine and a center to center distance between the first drum and the second drum.

* * * * *